US010930482B2

(12) United States Patent
Richardson et al.

(10) Patent No.: US 10,930,482 B2
(45) Date of Patent: *Feb. 23, 2021

(54) ADAPTIVE AND TARGETED CONTROL OF ION POPULATIONS TO IMPROVE THE EFFECTIVE DYNAMIC RANGE OF MASS ANALYSER

(71) Applicant: Micromass UK Limited, Wilmslow (GB)

(72) Inventors: Keith George Richardson, High Peak (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/871,782

(22) Filed: Jan. 15, 2018

(65) Prior Publication Data

US 2018/0138025 A1 May 17, 2018
US 2019/0019659 A9 Jan. 17, 2019

Related U.S. Application Data

(63) Continuation of application No. 14/353,802, filed as application No. PCT/GB2012/052692 on Oct. 29, 2012, now Pat. No. 9,870,903.

(60) Provisional application No. 61/556,475, filed on Nov. 7, 2011.

(30) Foreign Application Priority Data

Oct. 27, 2011 (GB) ..... 1118579

(51) Int. Cl.

| | |
|---|---|
| ***H01J 49/00*** | (2006.01) |
| ***H01J 49/02*** | (2006.01) |
| ***H01J 49/42*** | (2006.01) |
| ***H01J 49/06*** | (2006.01) |

(52) U.S. Cl.

CPC ..... *H01J 49/0031* (2013.01); *H01J 49/025* (2013.01); *H01J 49/06* (2013.01); *H01J 49/427* (2013.01); *H01J 49/4265* (2013.01)

(58) Field of Classification Search

CPC ..... H01J 49/0031; H01J 49/025; H01J 49/06; H01J 49/421; H01J 49/427; H01J 49/4265; H01J 49/4215

See application file for complete search history.

(56) References Cited

U.S. PATENT DOCUMENTS 4,851,673 A * 7/1989 Izumi ..... H01J 49/02 850/9
6,878,929 B2 * 4/2005 Green ..... H01J 49/0031 250/281

(Continued)

*Primary Examiner* — Wyatt A Stoffa

(74) *Attorney, Agent, or Firm* — Kacvinsky Daisak Bluni PLLC

(57) ABSTRACT

A method of mass spectrometry is disclosed wherein one or more relatively abundant or intense species of ions in a first population of ions are selectively attenuated so as to form a second population of ions. The total ion current of the second population of ions is then adjusted so that the ion current corresponding to ions which are onwardly transmitted to a mass analyser comprising an ion detector is within the dynamic range of the ion detector.

5 Claims, 2 Drawing Sheets

(56) References Cited

U.S. PATENT DOCUMENTS 7,745,781 B2 * 6/2010 Steiner ..... H01J 49/025 250/282
9,870,903 B2 * 1/2018 Richardson ..... H01J 49/025
2006/0006326 A1 * 1/2006 Belov ..... H01J 49/0431 250/282
2007/0284521 A1 * 12/2007 Green ..... H01J 49/06 250/283
2008/0061229 A1 * 3/2008 Burch ..... H01J 49/42 250/305
2008/0087816 A1 * 4/2008 McCauley ..... H01J 49/147 250/287
2008/0149825 A1 * 6/2008 Kozlovski ..... H01J 49/40 250/287
2009/0194688 A1 * 8/2009 Bateman ..... H01J 49/4215 250/292
2010/0019144 A1 * 1/2010 Schwartz ..... H01J 49/061 250/283
2010/0108879 A1 * 5/2010 Bateman ..... G01N 27/622 250/283
2012/0119078 A1 * 5/2012 Green ..... H01J 49/4265 250/282
2012/0305759 A1 * 12/2012 Park ..... H01J 49/424 250/282
2013/0181125 A1 * 7/2013 Guna ..... H01J 49/0031 250/282
2014/0117224 A1 * 5/2014 Tate ..... H01J 49/004 250/282
2014/0291504 A1 * 10/2014 Richardson ..... H01J 49/025 250/282
2015/0155150 A1 * 6/2015 Bateman ..... H01J 49/062 250/283
2016/0049286 A1 * 2/2016 Park ..... H01J 49/40 250/282

* cited by examiner

ADAPTIVE AND TARGETED CONTROL OF ION POPULATIONS TO IMPROVE THE EFFECTIVE DYNAMIC RANGE OF MASS ANALYSER

CROSS-REFERENCE TO RELATED APPLICATIONS

This application is a continuation of U.S. patent application Ser. No. 14/353,802, filed Apr. 24, 2014, which is a National Stage of International Application No. PCT/GB2012/052692, filed Oct. 29, 2012, which claims priority from and the benefit of U.S. Provisional Patent Application Ser. No. 61/556,475 filed on Nov. 7, 2011 and United Kingdom Patent Application No. 1118579.0 filed on Oct. 27, 2011. The entire contents of these applications are incorporated herein by reference.

BACKGROUND OF THE PRESENT INVENTION

The present invention relates to a mass spectrometer and a method of mass spectrometry. The preferred embodiment relates to apparatus and methods for improving the in-spectrum dynamic range of mass spectrometers.

Many modern applications of mass spectrometry involve fast analyses of complex samples containing components having a wide dynamic range. A typical example is High Pressure Liquid Chromatography ("HPLC") coupled to an Electrospray ion source for the analysis of peptides or smaller molecules. In these experiments, the composition of the mixture that is introduced into the mass analyser will vary on a timescale of the order of a few seconds. In view of the rapidly changing composition of the sample being analysed, it is clearly advantageous to identify as many components as possible in a short period of time.

However, due to the wide dynamic range of the samples involved much of the dynamic range of the analyser is needed to accommodate the most abundant species present.

It is known to attempt to enhance the dynamic range by suppressing all species simultaneously. It is desired to provide an improved mass spectrometer and method of mass spectrometry.

SUMMARY OF THE INVENTION

According to an aspect of the present invention there is provided a method of mass spectrometry comprising:

providing a first population of ions;

selectively attenuating one or more relatively abundant or intense species of ions in the first population of ions so as to form a second population of ions; and adjusting or optimising a total ion current of the second population of ions so as to form a third population of ions so that a total ion current of ions received by an ion detector is within a dynamic range of the ion detector.

According to an aspect of the present invention there is provided a method of mass spectrometry comprising:

providing a first population of ions;

adjusting or optimising a total ion current of the first population of ions so as to form a second population of ions; and selectively attenuating one or more relatively abundant or intense species of ions in the second population of ions so as to form a third population of ions so that a total ion current of ions received by an ion detector is within a dynamic range of the ion detector.

According to an aspect of the present invention there is provided a method of mass spectrometry comprising:

using an ion source to generate a first population of ions;

selectively attenuating one or more relatively abundant or intense species of ions in the first population of ions so as to form a second population of ions; and varying the efficiency of generation of ions by the ion source so as to adjust or optimise a total ion current of ions emitted by the ion source so that a total ion current of ions received by an ion detector is within the dynamic range of the ion detector.

According to an aspect of the present invention there is provided a method of mass spectrometry comprising:

using an ion source to generate a plurality of ions;

varying the efficiency of generation of ions by the ion source so as to adjust or optimise a total ion current of a first population of ions emitted by the ion source; and selectively attenuating one or more relatively abundant or intense species of ions in the first population of ions so as to form a second population of ions so that a total ion current of ions received by an ion detector is within the dynamic range of the ion detector.

According to an aspect of the present invention there is provided a method of mass spectrometry comprising:

providing a first population of ions;

selectively attenuating one or more relatively abundant or intense species of ions in the first population of ions so as to form a second population of ions; and adjusting or optimising a gain of an ion detector so that a detected ion signal corresponding to ions received by the ion detector is within a dynamic range of the ion detector.

According to an aspect of the present invention there is provided a method of mass spectrometry comprising:

providing a first population of ions;

adjusting or optimising a gain of an ion detector; and selectively attenuating one or more relatively abundant or intense species of ions in the first population of ions so as to form a second population of ions so that a detected ion signal corresponding to ions received by the ion detector is within a dynamic range of the ion detector.

According to an aspect of the present invention there is provided a method of mass spectrometry comprising:

selectively attenuating one or more relatively abundant or intense species of ions and adjusting or optimising a total ion current so that a detected ion signal is within a dynamic range of an ion detector.

The steps of selectively attenuating one or more relatively abundant or intense species and adjusting or optimising a total ion current may be achieved by coordinating the operation of a first ion-optical device and one or more second different ion-optical devices.

The first ion-optical device preferably comprises a device for separating ions according to their mass, mass to charge ratio, ion mobility, differential ion mobility or another physico-chemical property.

The first ion-optical device preferably comprises a time of flight region, an ion mobility separator or spectrometer or a differential ion mobility separator or spectrometer.

The one or more second ion-optical devices preferably comprises a device for filtering or attenuating ions having a particular mass, mass to charge ratio, ion mobility, differential ion mobility or another physico-chemical property.

The one or more second ion-optical devices preferably comprises a mass filter, an ion trap, an ion gate or a Dynamic Range Enhancement ("DRE") lens.

The steps of selectively attenuating one or more relatively abundant or intense species and adjusting or optimising a total ion current may alternatively be achieved by controlling the operation of a single ion-optical device.

The steps of selectively attenuating one or more relatively abundant or intense species of ions in a population of ions and adjusting or optimising a total ion current of the population of ions are preferably performed substantially simultaneously.

The single ion-optical device preferably comprises a mass filter which is preferably stepped with a variable dwell time or an ion trap.

The method preferably further comprises further adjusting or optimising a total ion current or an ion current using a mass filter, an ion trap or a Dynamic Range Enhancement ("DRE") lens.

The step of selectively attenuating one or more relatively abundant or intense species of ions preferably comprises:

(i) depleting one or more species of ions or completely removing one or more species of ions; and/or (ii) attenuating one or more species of ions by at least 10%, 20%, 30%, 40%, 50%, 60%, 70%, 80%, 90%, 95% or 100%.

The step of selectively attenuating one or more relatively abundant or intense species of ions and/or adjusting or optimising a total ion current preferably comprises:

(i) resonantly ejecting one or more relatively abundant or intense species of ions from an ion trap; and/or (ii) resonantly ejecting one or more relatively abundant or intense species of ions from a continuous ion beam using a quadrupole rod set mass filter; and/or (iii) separating a population of ions by ion mobility separation and then attenuating one or more relatively abundant or intense species of ions by time dependent attenuation of ions having ion mobilities within one or more particular ion mobility ranges; and/or (iv) separating a population of ions by axial time of flight separation and then attenuating one or more relatively abundant or intense species of ions by time dependent attenuation; and/or (v) filtering a population of ions one or more times with one or more non-overlapping mass or mass to charge ratio ranges and/or one or more non-overlapping ion mobility ranges and then accumulating ions having mass or mass to charge ratios and/or ion mobilities within the one or more non-overlapping mass or mass to charge ratio ranges and/or the one or more non-overlapping ion mobility ranges within an ion trap; and/or (vi) passing a population of ions into a mass filter and scanning the mass filter over a mass or mass to charge ratio range at a speed or with a dwell time that is dependent on mass or mass to charge ratio; and/or (vii) attenuating one or more relatively abundant or intense species of ions using one or more devices operating in series; and/or (viii) stepping a mass filter or quadrupole mass filter and varying the dwell time as the mass filter or quadrupole mass filter is being stepped.

The method preferably further comprises varying, increasing, decreasing, progressively increasing or progressively decreasing the number of relatively abundant or intense species of ions in a population of ions which are selectively attenuated during the course of a time period T.

The time period T is preferably selected from the group consisting of: (i) 0-1 s; (ii) 1-2 s; (iii) 2-3 s; (iv) 3-4 s; (v) 4-5 s; (vi) 5-6 s; (vii) 6-7 s; (viii) 7-8 s; (ix) 8-9 s; (x) 9-10 s; (xi) 10-15 s; (xii) 15-20 s; (xiii) 20-25 s; (xiv) 25-30 s; (xv) 30-35 s; (xvi) 35-40 s; (xvii) 40-45 s; (xviii) 45-50 s; (xix) 50-55 s; (xx) 55-60 s; and (xxi) >60 s.

The step of selectively attenuating one or more relatively abundant or intense species of ions preferably comprises either:

(i) increasing the number of relatively abundant or intense species of ions which are attenuated so as to allow for the detection of progressively less abundant or less intense species of ions; or (ii) decreasing the number of relatively abundant or intense species of ions which are attenuated so as to allow for the detection of progressively more abundant or more intense species of ions.

The method preferably further comprises re-adjusting or optimising an ion current of a population of ions and/or re-adjusting or optimising a gain of an ion detector after varying, increasing, or decreasing the number of relatively abundant or intense species of ions in a population of ions which are selectively attenuated.

The step of attenuating one or more relatively abundant or intense species of ions preferably comprises selectively attenuating the one or more relatively abundant or intense species of ions by:

(i) using a mass filter or ion trap; and/or (ii) time dependent attenuation using an ion gate or Dynamic Range Enhancement ("DRE") lens.

The step of adjusting or optimising a total ion current preferably comprises:

(i) using one or more electrostatic lenses to alter, deflect, focus, defocus, attenuate, block, expand, contract, divert or reflect an ion beam; and/or (ii) using one or more electrodes, rod sets, ion gates or ion-optical devices to alter, deflect, focus, defocus, attenuate, block, expand, contract, divert or reflect an ion beam.

The step of adjusting or optimising a total ion current preferably comprises repeatedly switching an attenuation device between a low transmission mode of operation and a high transmission mode of operation, wherein the attenuation device is maintained in the low transmission mode of operation for a time period $\Delta T1$ and the attenuation device is maintained in the high transmission mode of operation for a time period $\Delta T2$ and wherein the duty cycle of the attenuation device is given by $\Delta T2/(\Delta T1+\Delta T2)$.

The step of adjusting or optimising the total ion current of a population of ions preferably comprises adjusting the total ion current of the population of ions so that either:

(i) the number of ion species detected by an ion detector is optimised or maximized; and/or (ii) an ion detector is arranged to operate within a substantially linear regime; and/or (iii) the total ion current or ion current of ions supplied to a mass analyser and subsequently detected by an ion detector remains substantially constant with time.

The method preferably further comprises mass analysing a population of ions using a Time of Flight mass analyser or an ion trap mass analyser.

The method preferably further comprises adjusting a fill time of the ion trap mass analyser so that a total charge in the ion trap mass analyser remains approximately constant.

According to an aspect of the present invention there is provided a method of mass spectrometry comprising:

providing a first population of ions;

selectively attenuating N relatively abundant or intense species of ions in the first population of ions so as to form a second population of ions;

detecting the second population of ions or an ion population derived from the second population of ions; and then increasing, decreasing, varying or optimising the number N of relatively abundant or intense species of ions which are selectively attenuated so as to form a third population of ions.

The method preferably further comprises detecting the third population of ions or an ion population derived from the third population of ions.

The method preferably further comprises increasing, decreasing, varying or optimising an ion current of the first population of ions and/or the second population of ions and/or the third population of ions preferably so that an ion current of ions received by an ion detector is within a dynamic range of the ion detector.

The step of increasing, decreasing, varying or optimising an ion current preferably comprises:

(i) varying the efficiency of generation of ions by an ion source; and/or (ii) varying the intensity of ions onwardly transmitted by one or more ion-optical devices; and/or (iii) varying the gain of an ion detector so that a detected ion signal is within the dynamic range of the ion detector.

According to an aspect of the present invention there is provided a mass spectrometer comprising:

a device arranged and adapted to provide a first population of ions;

a selective attenuation device arranged and adapted to selectively attenuate one or more relatively abundant or intense species of ions in the first population of ions so as to form a second population of ions; and a device arranged and adapted to adjust or optimise a total ion current of the second population of ions so as to form a third population of ions so that a total ion current of ions received by an ion detector is within a dynamic range of the ion detector.

According to an aspect of the present invention there is provided a mass spectrometer comprising:

a device arranged and adapted to provide a first population of ions;

a device arranged and adapted to adjust or optimise a total ion current of the first population of ions so as to form a second population of ions; and a selective attenuation device arranged and adapted to selectively attenuate one or more relatively abundant or intense species of ions in the second population of ions so as to form a third population of ions so that a total ion current of ions received by an ion detector is within a dynamic range of the ion detector.

According to an aspect of the present invention there is provided a mass spectrometer comprising:

an ion source arranged and adapted to generate a first population of ions;

a selective attenuation device arranged and adapted to selectively attenuate one or more relatively abundant or intense species of ions in the first population of ions so as to form a second population of ions; and a device arranged and adapted to vary the efficiency of generation of ions by the ion source so as to adjust or optimise a total ion current of ions emitted by the ion source so that a total ion current of ions received by an ion detector is within the dynamic range of the ion detector.

According to an aspect of the present invention there is provided a mass spectrometer comprising:

an ion source arranged and adapted to generate a plurality of ions;

a device arranged and adapted to vary the efficiency of generation of ions by the ion source so as to adjust or optimise a total ion current of a first population of ions emitted by the ion source; and a selective attenuation device arranged and adapted to selectively attenuate one or more relatively abundant or intense species of ions in the first population of ions so as to form a second population of ions so that a total ion current of ions received by an ion detector is within the dynamic range of the ion detector.

According to an aspect of the present invention there is provided a mass spectrometer comprising:

a device arranged and adapted to provide a first population of ions;

a selective attenuation device arranged and adapted to selectively attenuate one or more relatively abundant or intense species of ions in the first population of ions so as to form a second population of ions; and a device arranged and adapted to adjust or optimise a gain of an ion detector so that a detected ion signal corresponding to ions received by the ion detector is within a dynamic range of the ion detector.

According to an aspect of the present invention there is provided a mass spectrometer comprising:

a device arranged and adapted to provide a first population of ions;

a device arranged and adapted to adjust or optimise a gain of an ion detector; and a selective attenuation device arranged and adapted to selectively attenuate one or more relatively abundant or intense species of ions in the first population of ions so as to form a second population of ions so that a detected ion signal corresponding to ions received by the ion detector is within a dynamic range of the ion detector.

According to an aspect of the present invention there is provided a mass spectrometer comprising:

a selective attenuation device arranged and adapted to selectively attenuate one or more relatively abundant or intense species of ions in combination with a device arranged and adapted to adjust or optimise a total ion current so that a detected ion signal is within a dynamic range of an ion detector.

The mass spectrometer preferably further comprises a first ion-optical device arranged and adapted to selectively attenuate one or more relatively abundant or intense species and one or more second different ion-optical devices arranged and adapted to adjust or optimise a total ion current, wherein the operation of the first ion-optical device is coordinated with the operation of the one or more second different ion-optical devices.

The first ion-optical device preferably comprises a device for separating ions according to their mass, mass to charge ratio, ion mobility, differential ion mobility or another physico-chemical property.

The first ion-optical device preferably comprises a time of flight region, an ion mobility separator or spectrometer or a differential ion mobility separator or spectrometer.

The one or more second ion-optical devices preferably comprise a device for filtering or attenuating ions having a particular mass, mass to charge ratio, ion mobility, differential ion mobility or another physico-chemical property.

The one or more second ion-optical devices preferably comprise a mass filter, an ion trap, an ion gate or a Dynamic Range Enhancement ("DRE") lens.

According to an embodiment the mass spectrometer may comprise a single ion-optical device arranged and adapted to selectively attenuate one or more relatively abundant or intense species and to adjust or optimise a total ion current.

The single ion-optical device is preferably arranged and adapted to selectively attenuate one or more relatively abundant or intense species of ions in a population of ions and to adjust or optimise a total ion current of the population of ions substantially simultaneously.

The single ion-optical device preferably comprises a mass filter which is preferably stepped with a variable dwell time or an ion trap.

The mass spectrometer preferably further comprises a mass filter, an ion trap, an ion gate or a Dynamic Range Enhancement ("DRE") lens arranged and adapted to further adjust or optimise a total ion current or an ion current.

The selective attenuation device is preferably arranged and adapted:

(i) to deplete one or more species of ions or to remove completely one or more species of ions; and/or (ii) to attenuate one or more species of ions by at least 10%, 20%, 30%, 40%, 50%, 60%, 70%, 80%, 90%, 95% or 100%.

The selective attenuation device and/or the device arranged and adapted to adjust or optimise a total ion current is preferably arranged and adapted:

(i) to resonantly eject one or more relatively abundant or intense species of ions from an ion trap; and/or (ii) to resonantly eject one or more relatively abundant or intense species of ions from a continuous ion beam using a quadrupole rod set mass filter; and/or (iii) to separate a population of ions by ion mobility separation and then attenuate one or more relatively abundant or intense species of ions by time dependent attenuation of ions having ion mobilities within one or more particular ion mobility ranges; and/or (iv) to separate a population of ions by axial time of flight separation and then attenuate one or more relatively abundant or intense species of ions by time dependent attenuation; and/or (v) to filter a population of ions one or more times with one or more non-overlapping mass or mass to charge ratio ranges and/or one or more non-overlapping ion mobility ranges and then accumulate ions having mass or mass to charge ratios and/or ion mobilities within the one or more non-overlapping mass or mass to charge ratio ranges and/or the one or more non-overlapping ion mobility ranges within an ion trap; and/or (vi) to pass a population of ions into a mass filter and scan the mass filter over a mass or mass to charge ratio range at a speed or with a dwell time that is dependent on mass or mass to charge ratio; and/or (vii) to attenuate one or more relatively abundant or intense species of ions using one or more devices operating in series; and/or (viii) to step a mass filter or quadrupole mass filter and vary the dwell time as the mass filter or quadrupole mass filter is being stepped.

The mass spectrometer preferably further comprises a control system which is arranged and adapted to vary, increase, decrease, progressively increase or progressively decrease the number of relatively abundant or intense species of ions in a population of ions which are selectively attenuated during the course of a time period T.

The time period T is preferably selected from the group consisting of: (i) 0-1 s; (ii) 1-2 s; (iii) 2-3 s; (iv) 3-4 s; (v) 4-5 s; (vi) 5-6 s; (vii) 6-7 s; (viii) 7-8 s; (ix) 8-9 s; (x) 9-10 s; (xi) 10-15 s; (xii) 15-20 s; (xiii) 20-25 s; (xiv) 25-30 s; (xv) 30-35 s; (xvi) 35-40 s; (xvii) 40-45 s; (xviii) 45-50 s; (xix) 50-55 s; (xx) 55-60 s; and (xxi) >60 s.

The mass spectrometer preferably further comprises a control system which is arranged and adapted either:

(i) to increase the number of relatively abundant or intense species of ions which are attenuated so as to allow for the detection of progressively less abundant or less intense species of ions; or (ii) to decrease the number of relatively abundant or intense species of ions which are attenuated so as to allow for the detection of progressively more abundant or more intense species of ions.

The mass spectrometer preferably further comprises a control system which is arranged and adapted to re-adjust or optimise an ion current of a population of ions and/or to re-adjust or optimise a gain of an ion detector after varying, increasing, or decreasing the number of relatively abundant or intense species of ions in a population of ions which are selectively attenuated.

The selective attenuation device preferably comprises:

(i) a mass filter or ion trap; and/or (ii) an ion gate or a Dynamic Range Enhancement ("DRE") lens which, in use, is arranged to attenuate ions in a time dependent attenuation manner.

The device arranged and adapted to adjust or optimise a total ion current of a population of ions preferably comprises:

(i) one or more electrostatic lenses arranged and adapted to alter, deflect, focus, defocus, attenuate, block, expand, contract, divert or reflect an ion beam; and/or (ii) one or more electrodes, rod sets, ion gates or ion-optical devices arranged and adapted to alter, deflect, focus, defocus, attenuate, block, expand, contract, divert or reflect an ion beam.

The device arranged and adapted to adjust or optimise a total ion current of a population of ions preferably comprises an attenuation device which in use is repeatedly switchable between a low transmission mode of operation and a high transmission mode of operation, wherein the attenuation device is maintained in the low transmission mode of operation for a time period $\Delta T1$ and the attenuation device is maintained in the high transmission mode of operation for a time period $\Delta T2$ and wherein the duty cycle of the attenuation device is given by $\Delta T2/(\Delta T1+\Delta T2)$.

The device arranged and adapted to adjust or optimise a total ion current of a population of ions is preferably arranged and adapted to adjust or optimise the total ion current of the population of ions so that either:

(i) the number of ion species detected by an ion detector is optimised or maximized; and/or (ii) an ion detector is arranged to operate within a substantially linear regime; and/or (iii) the total ion current or ion current of ions supplied to a mass analyser and subsequently detected by an ion detector remains substantially constant with time.

The mass spectrometer preferably further comprises a Time of Flight mass analyser or an ion trap mass analyser.

The mass spectrometer preferably further comprises a device arranged and adapted to adjust a fill time of the ion trap mass analyser so that a total charge in the ion trap mass analyser remains approximately constant.

According to an aspect of the present invention there is provided a mass spectrometer comprising:

a device arranged and adapted to provide a first population of ions;

a selective attenuation device arranged and adapted to selectively attenuate N relatively abundant or intense species of ions in the first population of ions so as to form a second population of ions;

an ion detector arranged and adapted to detect the second population of ions or an ion population derived from the second population of ions; and a control system arranged and adapted to increase, decrease, vary or optimise the number N of relatively abundant or intense species of ions which are selectively attenuated so as to form a third population of ions.

According to an embodiment in use the ion detector detects the third population of ions or an ion population derived from the third population of ions.

The mass spectrometer preferably further comprises a control system arranged and adapted to increase, decrease, vary or optimise an ion current of the first population of ions and/or the second population of ions and/or the third population of ions preferably so that an ion current of ions received by the ion detector is within a dynamic range of the ion detector.

The control system is preferably arranged and adapted to increase, decrease, vary or optimise an ion current:

(i) by varying the efficiency of generation of ions by an ion source; and/or (ii) by varying the intensity of ions onwardly transmitted by one or more ion-optical devices; and/or (iii) by varying the gain of an ion detector so that a detected ion signal is within the dynamic range of the ion detector.

According to a preferred embodiment of the present invention a total response control is used to keep the observed signal for all species within the dynamic range of an ion detector. Total response control may be achieved by altering the efficiency of ion production in the ion source (e.g. by adjusting the needle voltage of an ESI or APCI ion source) and/or by using an attenuation device in a non-targeted mode and/or by adjusting the detector gain for detectors using a photo-multiplier or electron-multiplier (i.e. controlling the detector response rather than ion population).

In some circumstances a single attenuation device may be used for both targeted attenuation and total response control. In this case all species are attenuated but the targeted species are attenuated to a greater degree.

Attenuation can be carried out by separating (e.g. according to ion mobility) and then attenuating (e.g. using a DRE lens) on a timescale shorter than the separation timescale. In general this combination allows both total ion current and targeted control.

Similarly, an ion trap may be used to perform both functions simultaneously by ejecting different proportions of different species.

Any filter (e.g. a quadrupole or FAIMS device) may be scanned at a variable speeds or followed by a DRE device and could also serve both functions but at a relatively low duty cycle.

According to certain embodiments the selective attenuation and total ion current control steps may be reversed e.g. where different parts of the instrument saturate in different ways (e.g. space charge effects in an ion trap are related to the total ion current while detector saturation is usually species by species).

According to an embodiment filters may either be operated continuously (e.g. scanning a quadrupole) or discretely (e.g. stepping a quadrupole). In the latter case, each channel may be attenuated differently either by changing the dwell time of the filter or by a separate means (e.g. a DRE device).

According to an embodiment a chromatographic experiment may be performed wherein data might be acquired over a period of e.g. 1 s. If this time period is short compared with the chromatographic peak width then it is possible to acquire several points across a peak width with different values of N (and therefore different detection limits). According to an embodiment the total ion current following attenuation may not increase with N (due to the attenuation) and might stay roughly constant if dominated by a few abundant species.

The preferred embodiment relates to an improvement to existing apparatus including Quadrupole Time of Flight mass spectrometers ("Q-TOFs") and ion trap mass analysers.

According to the preferred embodiment both the total ion current and the detailed composition of an ion population supplied to a mass analyser are preferably controlled in a data dependent manner in order to improve the effective dynamic range of the mass analyser.

According to an aspect of the present invention there is provided an apparatus and method for controlling a population of ions supplied to a mass analyser such that the composition of the ion population is modified to attenuate or completely remove one or more high abundance species whilst still fully utilizing the available dynamic range of the mass analyser.

The preferred embodiment has a high duty cycle and is compatible with fast separations of complex mixtures e.g. peptides or metabolites.

According to the preferred embodiment an increased number of components can be accurately characterized by mass spectrometry in fast separations of complex mixtures.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; and (xxi) an Impactor ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention will now be described, by way of example only, and with reference to the accompanying drawing in which.

DETAILED DESCRIPTION OF PREFERRED EMBODIMENTS

Figure 1:
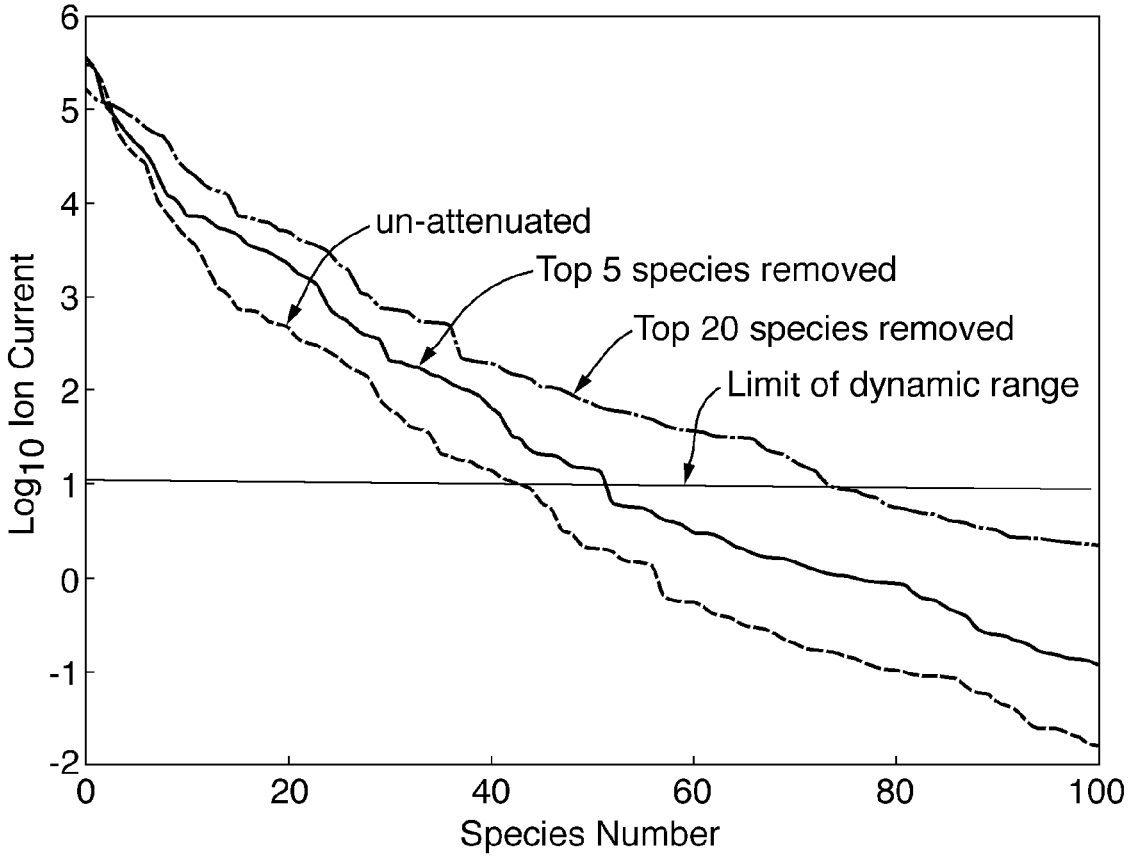
FIG. 1 illustrates simulated ion species distributions from an LC separation of a complex mixture before and after the removal of the most abundant ion species present.

A preferred embodiment of the present invention will now be described. According to the preferred embodiment a mass spectrometer is provided comprising a targeted attenuation device which is provided upstream of a mass analyser comprising an ion detector. The targeted attenuation device is preferably arranged and adapted to attenuate the most abundant ion species relative to other less abundant ion species before the ions are passed to the mass analyser. The total ion current is preferably re-optimised prior to the ions being passed to the mass analyser. The targeted attenuation device therefore preferably attenuates the most abundant ion species prior to the introduction of ions into a mass analyser thereby improving the in-spectrum dynamic range.

According to the preferred embodiment the total ion current of ions supplied to the mass analyser is preferably controlled or altered so as to optimise or maximize the number of ion species which can be detected by the mass analyser. At the same time, it is preferably ensured that the mass analyser operates in a linear regime for all ion species being analysed.

According to an embodiment, instead of controlling the total ion current of the ion population, the detector response may be controlled. In this embodiment, the gain of the ion detector may be controlled or adjusted so that the detected signal is within the dynamic range of the ion detector. This may be done when using, for example, photo-multiplier or electron multiplier detectors.

According to the preferred embodiment the observed signal for all ion species is preferably kept within the dynamic range of the ion detector by controlling the total response of the mass spectrometer. Control of the total response may be achieved in a number of ways.

According to an embodiment, the total ion current of ions supplied to the mass analyser may be controlled or adjusted by altering the amount or efficiency of ion production in the ion source. For Electrospray Ionisation ("ESI") or Atmospheric Pressure Chemical Ionisation ("APCI") sources this may be achieved by adjusting the needle voltage.

According to another embodiment, the total ion current of ions supplied to the mass analyser may be controlled or adjusted using an attenuation device (including those described below) operating in a non-targeted or non-selective mode of operation. According to this embodiment, all of the species of ions are attenuated substantially equally.

According to another embodiment, a single attenuation device may be used for both the targeted attenuation and the total response control or total ion current control. In this embodiment all of the ion species are preferably attenuated, but the targeted or selected ion species are preferably attenuated to a greater degree.

The composition of a sample being supplied to the mass analyser may according to an embodiment be frequently monitored in order to identify one or more highly abundant or intense ion species. For example, N highly abundant ion species may be identified.

The targeted attenuation device is preferably used to deplete in concentration (or completely remove) the N most abundant species of ions which have been previously identified. The N most abundant species of ions are preferably attenuated relative to the other remaining ion species. The N most abundant species of ions are preferably attenuated prior to injection into a mass analyser.

According to the preferred embodiment the total ion current or ion current may be re-optimised prior to injecting the ions into the mass analyser and/or the gain of the ion detector may be re-optimised.

In a particularly preferred embodiment, the approach according to the preferred embodiment as described above may be iterated over a sufficiently short timescale so that more of the most abundant species of ions are attenuated from successive spectra. In this way, ions having relatively high intensities or abundances may be successively attenuated from ions supplied to the mass analyser. For example, the five most abundant species of ions may be attenuated at first, followed by the ten most abundant species, followed by the fifteen most abundant species, and so on. After each successive step of attenuating different numbers of ion species, the total ion current or ion current may be re-optimised and/or the gain of the ion detector may be re-optimised.

The timescale for this iteration may be chosen so as to be compatible with the elution of components from an LC chromatography source. For example, the iteration may be operated over a timescale of the order of a few seconds or less. This embodiment allows for the detection of progressively less abundant ion species.

The degree to which each ion species has been attenuated will in general be known. Thus, according to the preferred embodiment, once a mass spectrum has been recorded, the attenuated components are scaled up in the data by the appropriate factor. In this way, an accurate mass spectrum may be produced.

According to an embodiment, the data produced from a number of iterations over, for example, an LC peak may be combined with the appropriate scaling to produce a mass spectrum for the LC peak with an increased effective dynamic range.

The number of attenuated ion species N, and the method of selecting ion species for attenuation may vary from sample to sample and from spectrum to spectrum, as desired. The specificity of the attenuation will depend on the characteristics of the attenuation device. It is possible that some ion species close in mass or mass to charge ratio (or some other physico-chemical characteristic such as ion mobility) to the target species may sometimes be attenuated to some extent. Nevertheless, the preferred embodiment will result in a higher proportion of the ion current being carried by lower abundance ion species.

A simulation was implemented to illustrate various aspects of the preferred embodiment. The simulation generated ion species with initial abundances sampled from a log-normal distribution. The width of the distribution was chosen to yield approximately 5000 species per decade of dynamic range of abundance. This particular choice of distribution is a reasonable approximation to the observed abundances of peptide species in an analysis of a proteolytic digest of a complex protein mixture.

The species were then subjected to a simulated LC separation of length 100 minutes during which time each species eluted at a randomly chosen retention time with a chromatographic full width half maximum of 12 seconds.

The total ion current was adjusted to keep the ion current for the most abundant species present at a roughly constant value. Since the total number of ions present is dominated by the most abundant species, this also corresponds to keeping the total ion current approximately constant.

While the specific values utilised in the above described simulation may be somewhat sensitive to the details of the assigned abundance distributions and simulated LC conditions, it will nonetheless be appreciated that the general conclusions still apply to a wide range of operating conditions.

FIG. 1 illustrates the results of the simulation wherein the most abundant species of ions in a single simulated spectrum from an LC separation of a complex mixture were removed in accordance with a preferred embodiment of the present invention.

The observed distribution in abundance over a is period is shown in FIG. 1 as the un-attenuated curve.

The ions have been sorted in FIG. 1 in decreasing order of abundance and the vertical axis shows the base 10 logarithm of the ion current for each species. Assuming that the ion detector has a dynamic range of 4.5 decades in abundance or sufficient charge capacity to hold about 1×106 ions, then the number of ion species that can be reliably measured at this retention time is just over 40.

When the top five species are completely removed in accordance with an embodiment of the present invention and the total ion current is adjusted to compensate, this number increases to just over 50 (i.e. an increase of 25% is observed in the number of species above the limit of dynamic range). The final experiment involved removing the top 20 most abundant species and again adjusting the total ion current to compensate. This yielded over 70 species within the dynamic range of the ion detector. This represents an increase of around 70% in the number of species above the limit of dynamic range over the case with no attenuation.

It is apparent, therefore, that the present invention represents a significant advance in the art.

The selective attenuation device 202, 303 may take a number of different forms. For example, according to an embodiment the selective attenuation 202, 303 device may utilise resonance ejection of selected mass or mass to charge ratio ranges of ions from an ion trap. According to another embodiment the selective attenuation device 202, 303 may utilise resonance ejection of ions from a continuous ion beam using a quadrupole rod set mass filter. According to another embodiment the selective attenuation device 202, 303 may trap ions, separate the ions according to their ion mobility and then attenuate ions in a time dependent manner so as to attenuate a particular mobility range of ions.

Yet further embodiments are contemplated. For example, the selective attenuation device 202, 303 may involve trapping ions, followed by separating ions axially using a time of flight region to separate the ions released from the ion trap. Ions may then be attenuated in a time dependent manner.

According to another embodiment the selective attenuation device 202, 303 may utilise multiple fills of an ion trap following a filtering device (such as a quadrupole rod set mass filter) operating with non-overlapping specificity in different spectra. According to another embodiment the selective attenuation device 202, 303 may utilise scanning or stepping a mass filter, such as a quadrupole mass filter, over the mass or mass to charge ratio range at a speed or with a dwell time that is linked to mass or mass to charge ratio. According to this embodiment, the speed of the scanning or stepping of the dwell time is preferably faster (or slower) over undesired or unselected mass or mass to charge ratio ranges, and slower (or faster) over desired or selected mass or mass to charge ratio ranges. According to this embodiment, a high resolution quadrupole mass filter may be utilised to attenuate with a mass or mass to charge ratio specificity better than 1 Da.

According to other embodiments combinations of the above described embodiments may be utilised including attenuation of ions having different mass or mass to charge ratio ranges or ion mobility ranges by several devices operating in series.

Time dependent attenuation may be achieved through a reduction in duty cycle using one or more known Dynamic Range Enhancement ("DRE") lenses or ion gates.

Various other attenuation methods are also possible.

The mass analyser preferably comprises a Time of Flight ("ToF") mass analyser and in particular a Time of Flight mass analyser having an ion detector which displays a non-linear behavior at high ion arrival rates due to the particular ion detection mechanism or due to the process of digitizing the signal.

Figure 2:
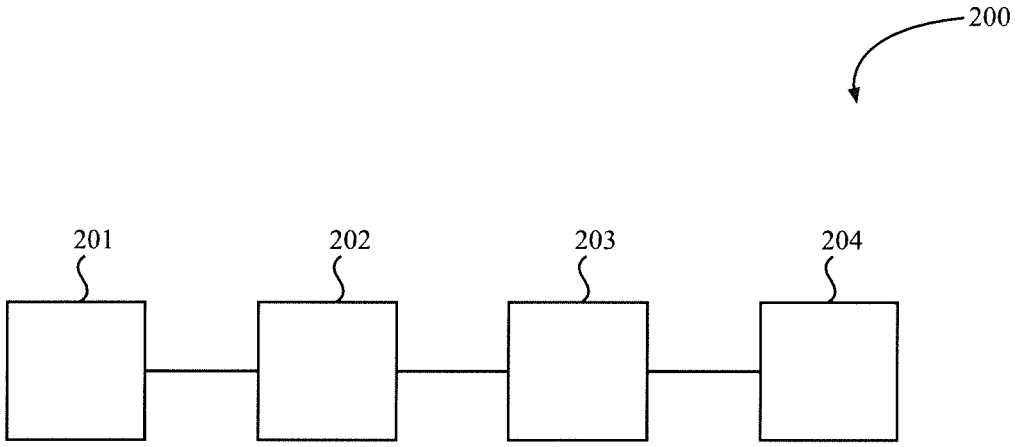
FIG. 2 schematically illustrates a mass spectrometer 200 according to an embodiment of the invention.

According to an aspect of the present invention as illustrated in FIG. 2 there is provided a mass spectrometer 200 comprising;

a device 201 arranged and adapted to provide a first population of ions;

a selective attenuation device 202 arranged and adapted to selectively attenuate one or more relatively abundant or intense species of ions in the first population of ions; so as to form a second population of ions; and a device 203 arranged and adapted to adjust or optimise a gain of an ion detector so that a detected ion signal corresponding to ions received by the ion detector 204 is within a dynamic range of the ion detector 204.

Figure 3:
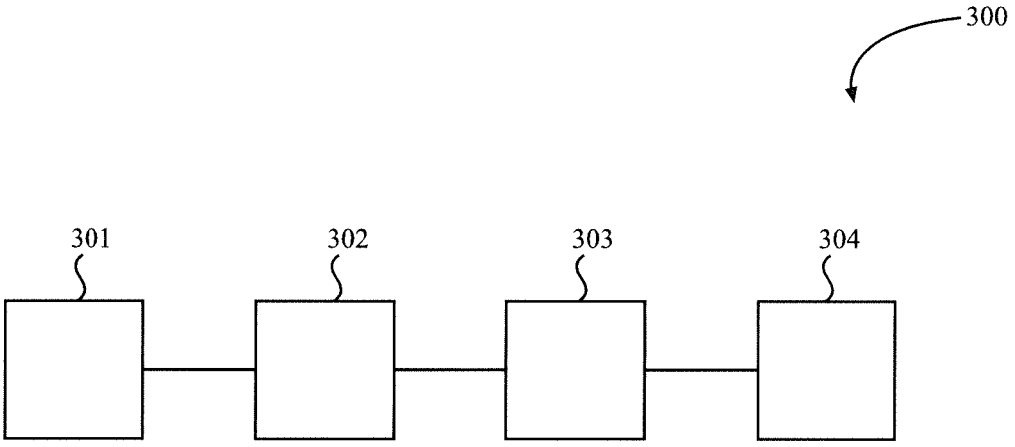
FIG. 3 schematically illustrates a mass spectrometer 300 according to another embodiment of the invention.

According to an aspect of the present invention as illustrated in FIG. 3 there is provided a mass spectrometer comprising:

a device 301 arranged and adapted to provide a first population of ions;

a device 302 arranged and adapted to adjust or optimise a gain of an ion detector; and a selective attenuation device 303 arranged and adapted to selectively attenuate one or more relatively abundant or intense species of ions in the first population of ions so as to form a second population of ions so that a detected ion signal corresponding to ions received by the ion detector 304 is within a dynamic range of the ion detector 304.

Alternatively, the mass analyser may comprise an ion trap mass analyser and in particular an ion trap mass analyser for which the charge capacity of the ion trap determines the linear dynamic range of the instrument. Such mass analysers include an Orbitrap™ mass analyser for which the charge capacity of the C-trap determines the number of ions that can be measured simultaneously.

For ion trap based detector systems the fill time may be adjusted to keep the total charge in the ion trap approximately constant.

The general principle described herein is also applicable to other modes of operation involving a population of ions and an ion detector with a limited dynamic range.

Although the present invention has been described with reference to the preferred embodiments, it will be understood by those skilled in the art that various changes in form and detail may be made without departing from the scope of the invention as set forth in the accompanying claims.

The invention claimed is:

1. A method of mass spectrometry, comprising:

selectively attenuating one or more relatively abundant or intense species of ions and adjusting or optimising a total ion current so that an ion signal is within a dynamic range of a downstream device; wherein:

said adjusting or optimizing the total ion current comprises attenuating all species of ions, and said one or more relatively abundant or intense species of ions are attenuated to a greater degree;

the steps of selectively attenuating one or more relatively abundant or intense species and adjusting or optimising the total ion current are achieved by controlling the operation of a mass filter or ion trap; and the steps of selectively attenuating one or more relatively abundant or intense species of ions in a population of ions and adjusting or optimising the total ion current of said population of ions are performed substantially simultaneously.

2. A method as claimed in claim 1, wherein the downstream device comprises a downstream analyser.

3. A method as claimed in claim 1, wherein the downstream device comprises a downstream mass analyser.

4. A method as claimed in claim 1, wherein the step of selectively attenuating one or more relatively abundant or intense species of ions comprises:

(i) depleting one or more species of ions or completely removing one or more species of ions; and/or (ii) attenuating one or more species of ions by at least 10%, 20%, 30%, 40%, 50%, 60%, 70%, 80%, 90%, 95% or 100%.

5. A method as claimed in claim 1, wherein the step of selectively attenuating one or more relatively abundant or intense species of ions comprises either:

(i) increasing the number of relatively abundant or intense species of ions which are attenuated so as to allow for the detection of progressively less abundant or less intense species of ions; or (ii) decreasing the number of relatively abundant or intense species of ions which are attenuated so as to allow for the detection of progressively more abundant or more intense species of ions.

* * * * *